US006742767B1

(12) United States Patent
Bruzek

(10) Patent No.: US 6,742,767 B1
(45) Date of Patent: Jun. 1, 2004

(54) FLOOR JACK APPARATUS AND METHOD

(75) Inventor: Daniel A. Bruzek, Ellendale, MN (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/388,417

(22) Filed: Mar. 17, 2003

(51) Int. Cl.[7] ..... B66F 7/16
(52) U.S. Cl. ..... 254/93 H; 254/89 H
(58) Field of Search ..... 60/479, 482, 481; 254/93 H, 93 R, 89 H

(56) References Cited

U.S. PATENT DOCUMENTS 3,972,267 A * 8/1976 Haak et al. ..... 91/445
5,755,099 A * 5/1998 Hung ..... 60/479
5,937,647 A * 8/1999 Hung ..... 60/479
5,992,149 A * 11/1999 Hu ..... 60/479
6,119,722 A * 9/2000 Zaehe ..... 137/494
6,199,379 B1 * 3/2001 Hung ..... 60/479

* cited by examiner

*Primary Examiner*—Lee D. Wilson
(74) *Attorney, Agent, or Firm*—Baker & Hostetler LLP

(57) ABSTRACT

A method and apparatus for moving a load. The apparatus is a floor jack that capable of reaching the load in a minimum amount of pumping by the operator. The lift reaches the load in a shorter amount of time so that the load can be moved quicker.

21 Claims, 3 Drawing Sheets

FLOOR JACK APPARATUS AND METHOD

FIELD OF THE INVENTION

Embodiments of the present invention generally relate to a floor jack. More particularly, a quick lift floor jack that can rise from a starting position to a load position in a short amount of time.

BACKGROUND OF THE INVENTION

Floor jacks are used to lift heavy objects or a load from one position to another position using hydraulic circuitry. Hydraulic fluid is moved from a fluid reservoir into an inner chamber of a cylinder rod that is connected with a load bearing surface. The load bearing surface is the surface that contacts the load to be lifted or moved by the floor jack. The hydraulic fluid is moved through various channels by the manual pumping of a pump by an operator. The fluid fills the cylinder rod and displaces it axially until the load is reached. Then the operator continues the pumping until the load is raised to the desired level. Once the desired load movement is completed, the hydraulic fluid is returned to the fluid reservoir through the channels for the next operation.

In conventional floor jacks the load bearing surface rises from a starting position at the same speed regardless of whether the jack has a load or not. The operator must wait until the load, such as a car, is lifted at the slow speed, to the desired height until he can work on it. The wait time and the pumping effort can waste time and be costly to small garage operators.

Therefore, there is a need for a floor jack that can reach the desired load quickly so as to decrease the wait time of the operator.

SUMMARY OF THE INVENTION

In one embodiment of the present invention, a hydraulic jack that can include an oil reservoir that can store a hydraulic fluid therein, an inner chamber axially that can be disposed within the oil reservoir, a piston rod axially disposed within the inner chamber, a piston rod chamber can be provided in the piston rod, a pump assembly that can have a pump piston that can reciprocate therein and a pumping chamber that can receive hydraulic fluid from the oil reservoir, wherein the pumping chamber's volume can be between about ¼ to ¾ of the piston rod chamber's volume, and a sequence valve that can be press fitted into the hydraulic channel, held in place by a plug, can include a spherical ball having a hydraulic interacting surface and regulates fluid flow from the pumping chamber to the piston rod chamber and the inner chamber. The hydraulic jack can further include hydraulic channels for fluid communication within the jack, a first inlet check valve that can allow fluid to flow in one direction between the oil reservoir and the pumping chamber, a first outlet check valve that can allow fluid to flow in one direction between the pumping chamber and the hydraulic channels, a second outlet check valve that can allow fluid to flow in one direction between the hydraulic channels and the piston rod chamber, a second inlet that can allow fluid to move from the hydraulic channels to a second chamber, a release valve that can allow fluid to return from the piston rod chamber to the oil reservoir, a sealing member that can provide a sealing relationship between the piston rod and an inner chamber wall, and a relief valve that can relieve pressure of the jack at a predetermine pressure. The fluid can act on a surface of the sealing member to move the piston rod axially. The pump piston can be moved reciprocally by a handle that can be attached thereto. The pumping chamber's volume can be between about ⅓ to ½ of the piston rod chamber's volume. The release valve can have a slot therein for fluid to travel and can be threaded into the hydraulic jack. The piston rod can have a connector that can be coupled to a load bearing surface.

In another embodiment, a method of moving a load is provided and can include pumping a pump piston with a handle, drawing fluid from an oil reservoir to a pumping chamber by a vacuum created by the pumping, moving the fluid from the pumping chamber to a piston rod chamber by additional pumping of the pump piston, extending a piston rod to contact a load with the fluid in the piston rod chamber, and extending the piston further to move the load by increasing the amount of fluid acting on the piston rod when needed by setting a sequence valve that can be pressed fitted and can have a spherical ball to open at a predetermined pressure so that fluid is supplied to an inner chamber of the piston rod to move the piston rod. The fluid may be hydraulic fluid and increasing the amount of fluid can occur when the piston rod reaches a load and requires additional fluid to move the load. The volume of the pumping chamber can be between about ¼ to ¾ of the volume of the piston rod chamber. Additionally, the volume of the pumping chamber can be between about ⅓ to ½ of the volume of the piston rod chamber.

In still another embodiment of the invention, a hydraulic floor jack can include a means for storing a hydraulic fluid, a means for moving fluid into and out of a pumping chamber, a means for channeling fluid from the pumping chamber to a piston rod chamber, a means for lifting a load, wherein the means for lifting contains the piston rod chamber, a means for increasing fluid that can act on the means for lifting when the means for lifting requires additional fluid to move a load, wherein the means for increasing fluid is pressed-fitted into the jack and has a spherical ball, and a means for returning fluid allows fluid to move from the piston rod chamber to the oil reservoir. The means for increasing fluid can be retained by a plug and the means for returning fluid can have a slot for allowing fluid to travel therein. The volume of pumping chamber can be between about ¼ to ¾ the volume of the piston rod chamber. Additionally, the volume pumping chamber can be between about ⅓ to ½ the volume of the piston rod chamber. The jack can further include a means for relief for relieving pressure in the jack at a predetermined pressure. The means for lifting a load can be connected to a load bearing surface. The floor jack can further include a means for sealing positioned between the means for lifting and an inner chamber wall so that fluid can act on the means for sealing and move the means for lifting.

In a further embodiment, a hydraulic jack can include an oil reservoir that can store a hydraulic fluid therein, an inner chamber that can be axially disposed within the oil reservoir, a piston rod that can be axially disposed within the inner chamber, a piston rod chamber can be provided in the piston rod, a pump assembly having a pump piston that can reciprocate therein and a pumping chamber that can receive hydraulic fluid from the oil reservoir, wherein the pumping chamber's volume can between about ¼ to ¾ of the piston rod chamber's volume, a sequence valve that can be press fitted into the hydraulic channel, held in place by a plug, can include a spherical ball having a hydraulic interacting surface and can regulate fluid flow from the pumping chamber to the piston rod chamber and the inner chamber, hydraulic channels for fluid communication within the jack, a first inlet check valve that can allow fluid to flow in one direction between the oil reservoir and the pumping chamber, a first outlet check valve that can allow fluid to flow in one direction between the pumping chamber and the hydraulic channels, a second outlet check valve that can allow fluid to flow in one direction between the hydraulic channels and the piston rod chamber, a second inlet that can allow fluid to move from the hydraulic channels to a second chamber, a release valve that can allow fluid to return from the piston rod chamber to the oil reservoir, a sealing member that can provide a sealing relationship between the piston rod and an inner chamber wall, and a relief valve that can relieve pressure of the jack at a predetermine pressure.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

The embodiments of the present invention are for a quick lift jack that is capable of contacting and lifting a load with a minimum amount of pumping.

Figure 1:
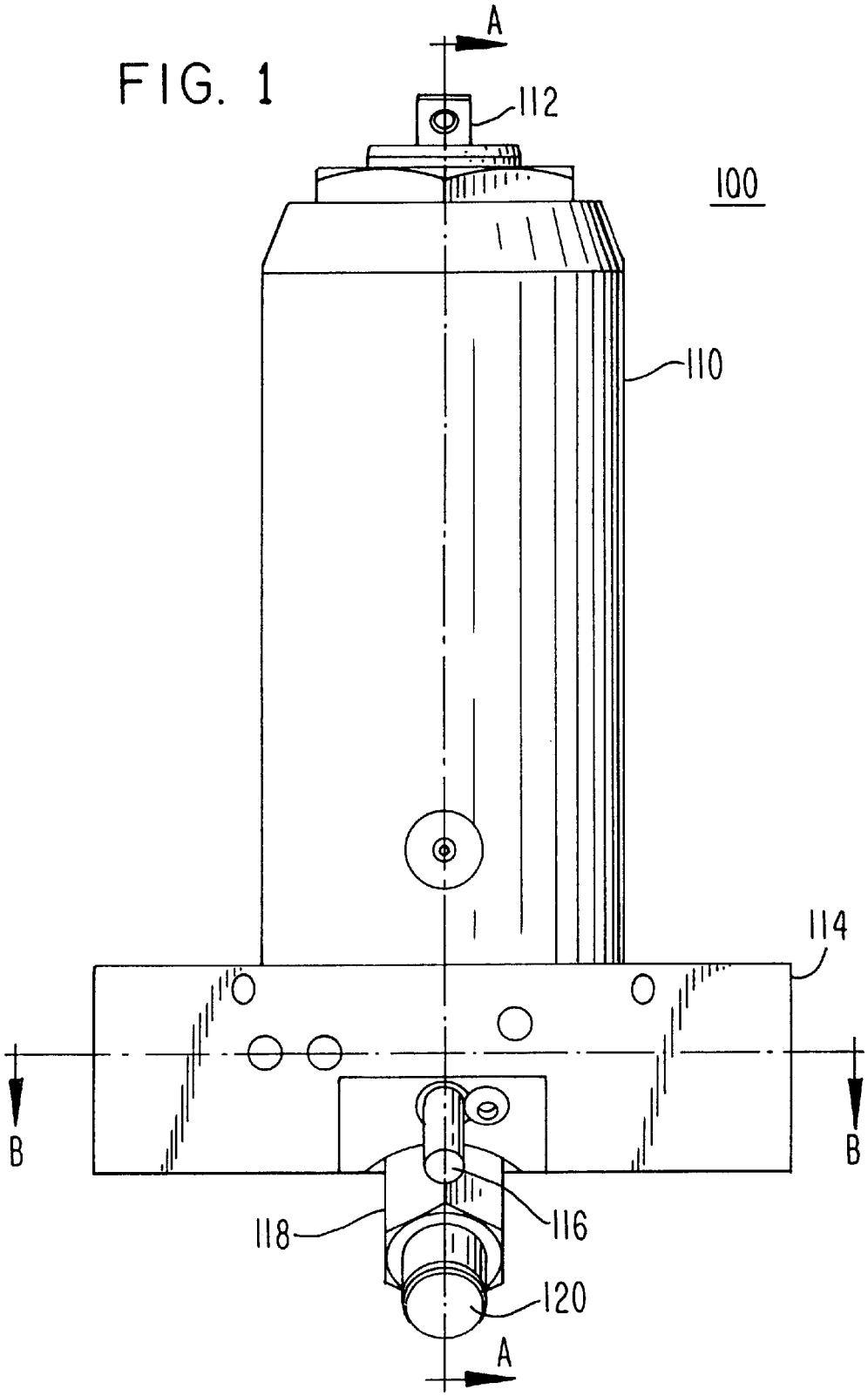
FIG. 1 is a front view of an embodiment of a floor jack.
Figure 2:
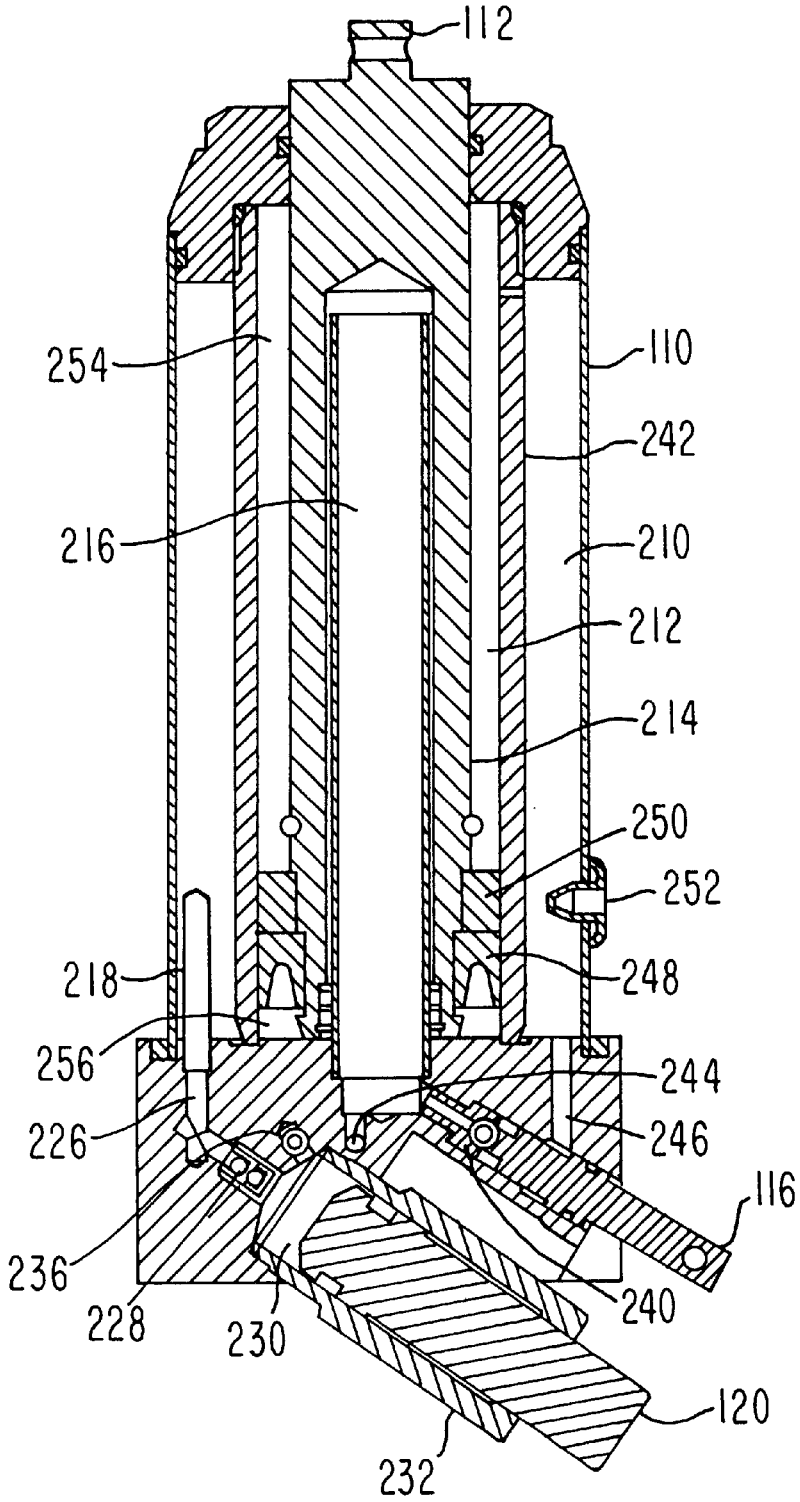
FIG. 2 is a cross-sectional view A—A of an embodiment of the floor jack.

FIG. 1 is a front view of an embodiment of a floor jack 100. The floor jack has a cylinder 110 that provides a housing for hydraulic fluid that is contained therein. At a first end of the cylinder 110 is a connector 112. The connector 112 can be attached to various devices, such as a load bearing surface. The load bearing surface is the surface of the floor jack 100 that will contact a load. The load is anything that needs to be moved by the jack. Movement of the load can be in any direction that an operator desires. Some examples of a load are a vehicle that needs its tire changed or a heavy object that needs to be moved because it is trapping a person. A base 114 is provided at the second end of the cylinder 110. The base 114 contains therein most of the hydraulic channels that are needed to move the hydraulic fluid throughout the floor jack 100. A pumping channel housing 118 is provided with a pumping chamber (not shown) and a pump piston 120. The pumping action of the pump piston 120 moves fluid from an oil reservoir 210 (FIG. 2) and extends a piston rod 214 (FIG.2). A release valve 116 is used to allow the fluid to move back into the oil reservoir and is further discussed below.

FIG. 2 is a cross-sectional view A—A of an embodiment of the floor jack 100. The floor jack 100 has the cylinder 110 and an inner chamber housing 242. The oil reservoir 210 has hydraulic fluid therein and is formed by the cylinder 110 and the inner chamber housing 242. At an end of the reservoir 210, there is a filter 218 that filters out any contaminants that may be in the hydraulic fluid and prevents the contaminants from clogging up the hydraulic system. The filter 218 can be made from stainless steel or other materials. The hydraulic fluid can be any fluid including oil, water, automatic transmission fluid, lubricants and other fluids that can be moved from one place to another in the floor jack 100. The oil reservoir 210 is filled with hydraulic fluid by removing a plug 252, which provides access to the oil reservoir.

An inner chamber 212 is formed by the inner chamber housing 242 and has a piston rod 214 therein. Between the outer surface of piston rod 214 and inner surface of the inner chamber housing 242 and in sealing contact are a U-cup 248 and a bearing 250. The U-cup 248 and the bearing 250 divide the inner chamber 212 into a first chamber 254 and a second chamber 256. The second chamber 256 receives fluid from the oil reservoir through a channel and a check valve (not shown). The piston rod 214 has a piston rod chamber 216 formed therein to receive hydraulic fluid from the oil reservoir 210. When the piston rod chamber 216 receives hydraulic fluid, it moves the piston rod 214 axially from a resting position to an extended position. As the piston rod 214 is extend, a vacuum is created in the second chamber 256 and draws fluid from the oil reservoir 210. The piston rod 214 at one end has the connector 112 that can connect to the load bearing surface or any other type of device that requires movement under hydraulic power.

The filter 218 is fluidly connected to a first end of a first channel 226 at its first end. At the second end, the first channel 226 is connected to a first inlet check valve 228. The first inlet check valve 228 allows the hydraulic fluid to flow in one direction, that is from the first channel 226 to a pumping chamber 230 that is formed in a pumping chamber housing 232. The pump chamber 230 stores hydraulic fluid that will eventually be transferred to the piston rod chamber 216. The pumping chamber housing 232 also has the pump piston 120 provided therein. The pump piston 120 can be connected to a handle (not shown), which an operator can use to move the pump piston 120 reciprocally in the pumping chamber housing 232. The reciprocating movement, on the upstroke, of the pump piston 120 creates a vacuum and draws the hydraulic fluid from the oil reservoir 210 through the filter 218 and the first channel 226, into the pumping chamber 230 and will be transferred to the piston rod chamber 216 via channels discussed below. On the down stroke, the pump piston 120 drives the fluid into a first outlet 236, which then travels to a second outlet 244. The first and second outlets 236, 244 have a ball check valve therein that allows fluid to flow in one direction.

The release valve 116, located near the same end of the piston rod chamber 216 as the second outlet 244, allows the fluid to flow back from the piston rod chamber to the oil reservoir 210 via a second channel 246. The release valve 116 can be threaded in place and holds a ball in a closed position of a first ball screw assembly 240. The first ball screw assembly can also be a check valve. The ball in the closed position prevents fluid from flowing from the piston rod chamber 216 into a slot (not shown) in the release valve 116. The slot is constructed within the release valve 116 so that hydraulic fluid can flow from the first ball screw assembly 240 to the second channel 246. Once the operator is ready for the piston rod 214 to return to its starting position, the operator can turn the release valve 116 in one direction, which allows the ball of the first ball screw assembly 240 to move due to the fluid pressure from the piston rod chamber 216. Thus, fluid from the piston rod chamber 216 can return to the oil reservoir 210 for later use.

Figure 3:
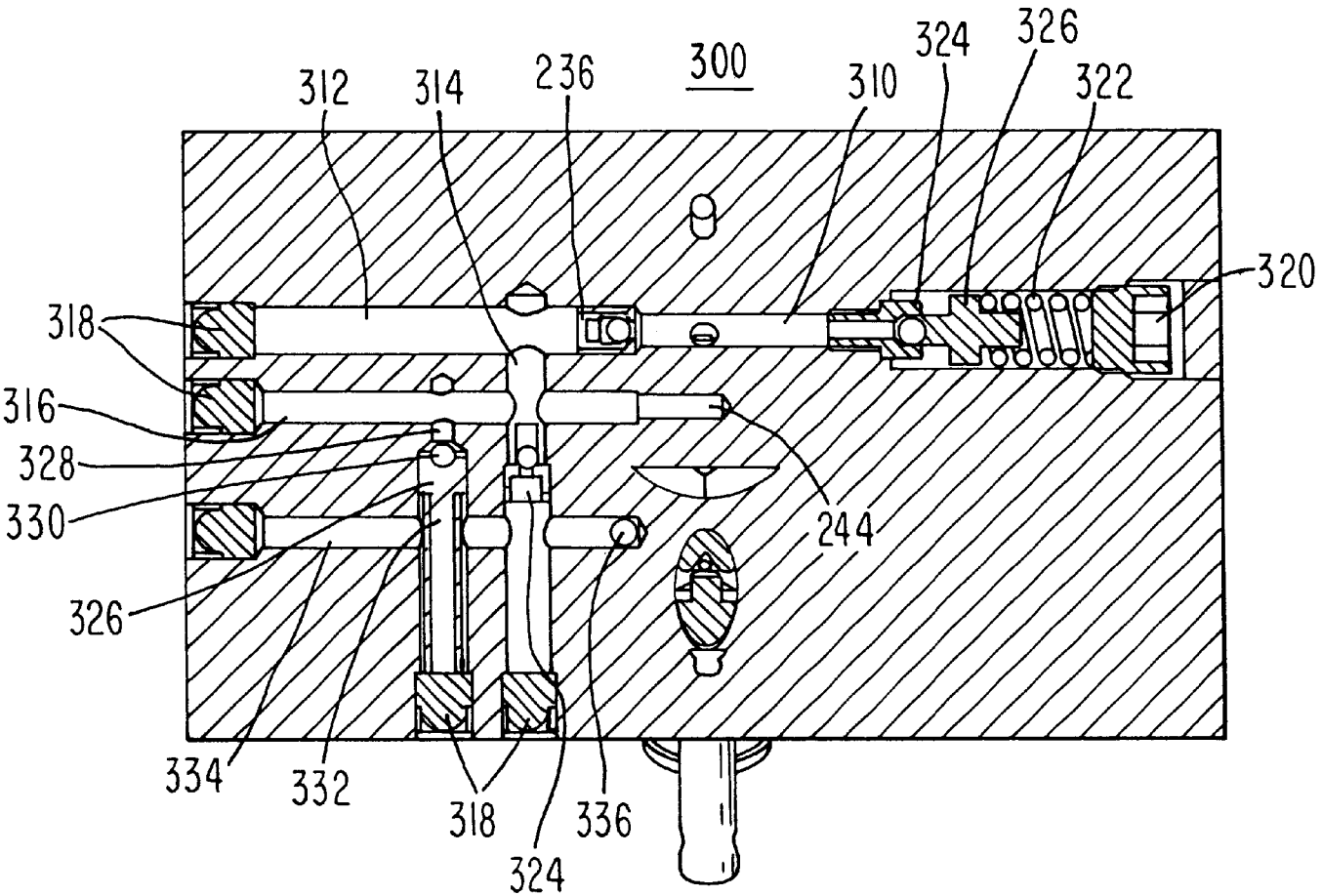
FIG. 3 is a cross-sectional view B—B of hydraulic channel assembly of the floor jack.

FIG. 3 is a cross-sectional view B—B of hydraulic channel assembly 300 of the floor jack 100. Hydraulic fluid is driven by the reciprocating action of the pump piston 120 from the pumping chamber 230 to the first outlet 236, which is shown with its ball check valve. At this point, the hydraulic fluid can travel to a relief valve 320 via a third channel 310 or to the second outlet 244 via a fourth channel 312 to a fifth channel 314 and finally to a sixth channel 316 that is connected with the second outlet 244. The relief valve 320 can include a spring 322 that biases a ball guide 326 that keeps a ball of a second ball screw assembly 324 in a closed position. The second ball screw assembly 324 can also be a check valve. The relief valve 320 is constructed and designed to open and relieve the pressure from pumping chamber 230 when there is excessive pressure exerted on it during lifting of the load. The relief valve 320 is adjustable so that the pressure limit, in which relief is required, can be set by the operator so that the jack 100 does not exceed its load limit.

Under normal use, the fluid travels in the direction of the relief valve 320 will stop at the relief valve and the remainder of the fluid will travel to the fourth channel 312. As the fluid travels in the fourth channel 312, it will hit a plug 318. The fluid is then forced down into the fifth channel 314, and can travel to the sixth channel 316. The fluid is stopped from further traveling down the fifth channel 314 because of a check valve assembly 324 that has a ball biased in the closed position. Additionally, a sequence valve 326 prevents the fluid from traveling down a seventh channel 328. Plug 318 prevents the fluid from further traveling in one direction of the sixth channel 316 and the fluid then travels to the second outlet 244 and then to the piston rod chamber 216.

The sequence valve 326 is press-fitted by the plug 318 into the seventh channel 328 and has a spherical ball 330 at one end. The spherical ball 330 is seated on a ball guide 332 that is biased by a spring (not shown). The spherical ball 330 prevents fluid from entering an eight channel 334, which can fluidly communicate with the a second inlet 336 that feeds fluid to the inner chamber 212. The sequence valve 326 will open when additional fluid is need by the piston rod 214 for additional extended movement; for example, when the piston rod 214 hits a load and needs more fluid pressure to lift the load. At this point, fluid will enter the first outlet 236 and will push the ball 330 of the sequence valve 326 to allow fluid to the flow into the eight channel 334 and to the second inlet 336. When fluid enters the inner chamber 212 from the second inlet 336, it will enter the second chamber 256 portion of the inner chamber 212 and acts on the U-cup 248 (FIG. 2) to further move the piston rod 214. The fluid acting on the U-cup 248 is acting in concert with the fluid in the piston rod chamber 216 so that the piston rod 214 can further extend and move the load.

In operation, the operator uses the handle to move the pump piston 120 and the upstroke creates a vacuum to draw hydraulic fluid from the oil reservoir 210. The fluid travels from the oil reservoir 210 through the filter 218, to the first channel 226, through the first inlet check valve 228 and to the pumping chamber 230. The pumping chamber's 230 volume is less than the volume of the piston rod chamber 216. The pumping chamber's 230 volume can be any volume so long as the volume does not equal the volume of the piston rod chamber 216. The volume of the pumping chamber 230 can range from ¼ to ¾ and from ⅓ to ½ of the volume of the piston rod chamber 216. Because the volume of the pumping chamber 230 is less than the volume of the piston rod chamber 216, it will take more than one stroke of the pump in order for the piston rod 214 to fully extend. This will decrease the likelihood of damaging the load bearing surface of the floor jack 100 that can occur with a more rapid approach to a load, such as when the volumes of the pumping chamber 230 and the piston rod chamber 216 are equal. This also helps to decrease the likelihood that the jack 100 will tip over when it is being pumped without a load.

On the down stroke of the pumping by the operator, the pump piston 120 pushes the fluids from the pumping chamber 230 and into the first outlet 236. From the first outlet 236, the fluid travels in the fourth channel 312 to the fifth channel 314, then to the sixth channel 316 and the second outlet 244. The fluid from the second outlet 244 fills the piston rod chamber 216 with each pump. When the piston rod chamber 216 is filled, it begins to extend the piston rod 214 with its load bearing surface in order to reach the load. As the piston rod 214 extends, it creates a vacuum in the second chamber 256 and draws fluid into it.

Once the load bearing surface reaches the load, additional pumping of the pump piston 120 will move the piston rod 214, but it will also force the fluid through the sequence valve 326, then to the eight channel 334 and the second inlet 336. The fluid from the second inlet 336 will further fill the second chamber 256 of the inner chamber 212, thereby pushing against the U-cup 248 and further moving the piston rod 214. The operator continues pumping until the load is moved to its desired position or until the piston rod 214 reaches its full extension.

In order to return the piston rod 214 to its starting position, the fluid must be moved from the piston rod chamber 216 and the second chamber 256 of the inner chamber 212. The operator can unscrew the release valve 116, so that the ball of the first ball screw assembly 240 can move and allow the fluid from the piston rod chamber 216 to move to the oil reservoir 210 via the slot in the release valve 116 and the second channel 246.

The fluid from the second chamber 256 can move back through the second inlet 336 and into the eighth channel 334. The fluid under pressure can move through the ball of the second ball screw assembly 324 and into the sixth channel 316. The sixth channel 316 connects with the second outlet 244 so that the fluid can move into the piston rod chamber 216 and back into the oil reservoir 210, as previously described. Once the oil returns to the oil reservoir 210, fluid is again available for the next use.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

I claim:

1. A hydraulic jack, comprising an oil reservoir that stores a hydraulic fluid therein;

an inner chamber axially disposed within the oil reservoir;

a piston rod axially disposed within the inner chamber;

a piston rod chamber is provided in the piston rod;

a pump assembly having a pump piston that reciprocates therein and a pumping chamber that receives hydraulic fluid from the oil reservoir, wherein the pumping chamber's volume is between about ¼ to ¾ of the piston rod chamber's volume; and a sequence valve that is press fitted into the hydraulic channel, held in place by a plug, includes a spherical ball having a hydraulic interacting surface and regulates fluid flow in one direction from the pumping chamber to the piston rod chamber and the inner chamber.

2. The hydraulic jack of claim 1 further comprising:

hydraulic channels for fluid communication within the jack;

a first inlet check valve that allows fluid to flow in one direction between the oil reservoir and the pumping chamber;

a first outlet check valve that allows fluid to flow in one direction between the pumping chamber and the hydraulic channels;

a second outlet check valve that allows fluid to flow in one direction between the hydraulic channels and the piston rod chamber;

a second inlet that allows fluid to move from the hydraulic channels to a second chamber;

a release valve that allows fluid to return from the piston rod chamber to the oil reservoir;

a sealing member that provides a sealing relationship between the piston rod and an inner chamber wall; and a relief valve that relieves pressure of the jack at a predetermine pressure.

3. The hydraulic jack of claim 2, wherein the fluid acts on a surface of the sealing member to move the piston rod axially.

4. The hydraulic jack of claim 2, wherein the release valve has a slot therein for fluid to travel and is threaded into the hydraulic jack.

5. The hydraulic jack of claim 1, wherein the pump piston is moved reciprocally by a handle that can be attached thereto.

6. The hydraulic jack of claim 1, wherein the pumping chamber's volume is between about ⅓ to ½ of the piston rod chamber's volume.

7. The hydraulic jack of claim 1, wherein the piston rod has a connector that can be coupled to a load bearing surface.

8. A method of moving a load, comprising:

pumping a pump piston with a handle;

drawing fluid from an oil reservoir to a pumping chamber by a vacuum created by the pumping;

moving the fluid from the pumping chamber to a piston rod chamber by additional pumping of the pump piston;

extending a piston rod to contact a load with the fluid in the piston rod chamber; and extending the piston further to move the load by increasing the amount of fluid acting on the piston rod when needed by setting a sequence valve that is pressed fitted and has a spherical ball to open at a predetermined pressure so that fluid is supplied in one direction to an inner chamber of the piston rod to move the piston rod.

9. The method of claim 8, wherein the fluid is hydraulic fluid.

10. The method of claim 8, wherein increasing the amount of fluid occurs when the piston rod reaches a load and requires additional fluid to move the load.

11. The method of claim 8, wherein the volume of the pumping chamber is between about ¼ to ¾ of the volume of the piston rod chamber.

12. The method of claim 8, wherein the volume of the pumping chamber is between about ⅓ to ½ of the volume of the piston rod chamber.

13. A hydraulic floor jack, comprising:

means for storing a hydraulic fluid;

means for moving fluid into and out of a pumping chamber;

means for channeling fluid from the pumping chamber to a piston rod chamber;

means for lifting a load, wherein the means for lifting contains the piston rod chamber;

means for increasing fluid in one direction that can act on the means for lifting when the means for lifting requires additional fluid to move a load, wherein the means for increasing fluid is pressed-fitted into the jack and has a spherical ball; and means for returning fluid allows fluid to move from the piston rod chamber to the oil reservoir.

14. The hydraulic floor jack of claim 13, wherein the means for increasing fluid is retained by a plug.

15. The hydraulic floor jack of claim 13, wherein the means for returning fluid has a slot for allowing fluid to travel therein.

16. The hydraulic floor jack of claim 13, wherein the volume of pumping chamber is between about ¼ to ¾ the volume of the piston rod chamber.

17. The hydraulic floor jack of claim 13, wherein the volume pumping chamber is between about ⅓ to ½ the volume of the piston rod chamber.

18. The hydraulic floor jack of claim 13 further comprising a means for relief for relieving pressure in the jack at a predetermined pressure.

19. The hydraulic floor jack of claim 13, wherein the means for lifting a load is connected to a load bearing surface.

20. The hydraulic floor jack of claim 13, wherein further comprising a means for sealing positioned between the means for lifting and an inner chamber wall so that fluid can act on the means for sealing and move the means for lifting.

21. A hydraulic jack, comprising an oil reservoir that stores a hydraulic fluid therein;

an inner chamber axially disposed within the oil reservoir;

a piston rod axially disposed within the inner chamber;

a piston rod chamber is provided in the piston rod;

a pump assembly having a pump piston that reciprocates therein and a pumping chamber that receives hydraulic fluid from the oil reservoir, wherein the pumping chamber's volume is between about ¼ to ¾ of the piston rod chamber's volume;

a sequence valve that is press fitted into the hydraulic channel, held in place by a plug, includes a spherical ball having a hydraulic interacting surface and regulates fluid flow in one direction from the pumping chamber to the piston rod chamber and the inner chamber;

hydraulic channels for fluid communication within the jack;

a first inlet check valve that allows fluid to flow in one direction between the oil reservoir and the pumping chamber;

a first outlet check valve that allows fluid to flow in one direction between the pumping chamber and the hydraulic channels;

a second outlet check valve that allows fluid to flow in one direction between the hydraulic channels and the piston rod chamber;

a second inlet that allows fluid to move from the hydraulic channels to a second chamber;

a release valve that allows fluid to return from the piston rod chamber to the oil reservoir;

a sealing member that provides a sealing relationship between the piston rod and an inner chamber wall; and a relief valve that relieves pressure of the jack at a predetermine pressure.

* * * * *